US005799753A

United States Patent [19]

Peltier

[11] Patent Number: 5,799,753

[45] Date of Patent: Sep. 1, 1998

[54] ANTI-FALL SECURITY APPARATUS

[76] Inventor: Marcel José Peltier, 1 allée Armande Béjart, 92190 Meudon, France

[21] Appl. No.: 669,476

[22] PCT Filed: Jan. 4, 1995

[86] PCT No.: PCT/FR95/00006

§ 371 Date: Jul. 3, 1996

§ 102(e) Date: Jul. 3, 1996

[87] PCT Pub. No.: WO95/18650

PCT Pub. Date: Jul. 13, 1995

[30] Foreign Application Priority Data

Jan. 5, 1994 [FR] France ..... 94 00059

[51] Int. Cl.[6] ..... A62B 1/10

[52] U.S. Cl. ..... 182/234; 182/241; 188/65.3

[58] Field of Search ..... 182/234, 241, 182/236, 239, 71; 188/65.3, 65.4

[56] References Cited

U.S. PATENT DOCUMENTS

| | | | |
|---|---|---|---|
| 1,116,434 | 11/1914 | Johansson | 182/241 |
| 1,798,844 | 3/1931 | Johansson | 182/241 |
| 3,946,989 | 3/1976 | Tsuda | 182/241 |

FOREIGN PATENT DOCUMENTS

| | | |
|---|---|---|
| A-0272908 | 6/1988 | European Pat. Off. . |
| A-2149047 | 3/1973 | France . |
| A-2513886 | 4/1983 | France . |
| A-P-06451 | 5/1915 | United Kingdom . |
| A-665038 | 1/1952 | United Kingdom . |

*Primary Examiner*—Alvin C. Chin-Shue
*Attorney, Agent, or Firm*—Horst M. Kasper

[57] ABSTRACT

A fall-arresting apparatus comprising a pair of connected spaced-apart shell with a flange and pulley rotatably mounted thereto via a common shaft. The flange being movable between two operative positions in which abutment portions break and stop a flexible linkage, and an inoperative position wherein the flexible linkage slides through a channel in the pulley.

22 Claims, 6 Drawing Sheets

ANTI-FALL SECURITY APPARATUS

BACKGROUND OF THE INVENTION

1. Field of the Invention

This present invention relates to an anti-fall security apparatus mainly destined for workers moving and operating at heights or on inclined planes, for example on ladders, pylons, chimneys, roofs, facades or in wells, and allowing these workers or loads to rise or to descend along a flexible tie, e.g. a cable, a rope, or a strap.

2. Brief Description of the Background of the Invention Including Prior Art

It is possible to classify the anti-fall security apparatuses into two main categories depending on their use with a fixed or a running hook-up point.

The first category concerns the apparatuses destined to be hooked to a fixed point at a height and linked to a worker or to a load by means of a movable cable coming from the apparatus.

In this category, a winding apparatus, including a cable attached by an end to a drum and wound up on the drum, the other end of the cable being fixed, for example, to the harness of the worker, is already known. In case of a fall of the latter, a locking mechanism, controlled by centrifugal force, locks the drum in rotation, which interrupts the unwinding of the cable and stops instantly the fall of the worker.

This apparatus presents many drawbacks, namely a risk of breaking the cable or a risk of deterioration of the cable as a result of the direct connection to the drum, an unsuitability to use with a running hook-up point, and a very high weight load.

Furthermore, when the worker frees the end of the cable to which he is directly attached, this cable is drawn back towards the apparatus by a return spring, which deprives of the worker of any use of the apparatus.

The second category with a "running" hook-up point concerns the apparatuses destined to slide or to roll in both directions along a cable, the worker being linked to the framework of the apparatus, for example, by means of a harness.

An apparatus is already known in this category, which apparatus allows to carry out a braking on the cable by means of a locking jaw, which jaw grips the cable by swinging and tilting following the fall of the worker.

However, this apparatus is not very reliable, indeed dangerous because, if the worker hooks to the apparatus during his fall, which is frequent in such a situation, the braking cannot take place, because the notched jaw is no longer actuated by the fall of the worker.

Moreover, this apparatus operates only in one direction, which can constitute a danger if the apparatus is installed on the cable in the wrong direction.

Another apparatus is known which can function regardless of the direction of its installation on the cable, and which is made of two wheel disks, wherein a circular grooved pulley for receiving a flexible cable is loosely mounted between the opposite faces of the wheel disks. Locking means are respectively formed on the faces opposite to the pulley and the wheel disks in order to allow selectively the locking in relative rotation of the latter ones when the centrifugal force, generated by the rotation of the pulley, exceeds a predetermined threshold value, and the free rotation of the pulley in the other case. The braking of the cable in case of a fall is obtained by a penetration of the cable into the groove of the pulley based on the force generated by the fall, and the particular profile of the groove brings about a gripping of the cable.

However, none of the apparatuses of this second category can be adapted for use with a fixed hook-up point.

SUMMARY OF THE INVENTION

1. Purposes of the Invention

It is an object of the present invention to avoid the drawbacks mentioned above and to propose an anti-fall security apparatus, which operates in both directions, which is extremely reliable as far as security is concerned, which avoids any deterioration of the cable, which is adaptable for use with a fixed or a running hook-up point, which can be easily released or unlocked, which is of a low weight, and which is simple to manufacture and of low costs.

These and other objects and advantages of the present invention will become evident from the description which follows.

2. Brief Description of the Invention

To this effect, the present invention provides for an anti-fall security apparatus including at least one wheel disk. A ring-grooved pulley is idly supported between the inner face of wheel disk and receives a flexible tie. Locking means are formed respectively on the opposite faces of said pulley and said wheel disk in order to allow selectively the locking in relative rotation of said pulley and of said wheel disk when the centrifugal force, generated by the rotation of the pulley, exceeds a predetermined threshold value, and the free rotation of the pulley in the other case. The invention is characterized in that said apparatus includes moreover two covers, interdependent and spaced from one another. On the inner faces of the covers and opposite to said inner faces, said wheel disks and said pulley are rotated by means of a common rotation axle. Each wheel disk is able to displace between at least two active inclined positions, in which active positions at least two abutting elements cooperate in order to brake and immobilize said flexible tie, for example by pinching, gripping or clamping, and a central position, called rest position, in which rest position the flexible tie can slide in the groove of the said pulley. The abutting elements are provided on the periphery of said wheel disk and of said cover, respectively.

In the apparatus of the present invention, the locking of the pulley and the braking of the flexible tie are thus carried out by different means but which cooperate with each other.

The wheel disks serve as a movable abutting device allowing to perform the braking of the flexible tie in case of a fall of a worker or of a load.

According to an embodiment of the invention, every wheel disk is urged towards said rest position by restoring elastic means, such as springs, linking said covers to said wheel disk. This facilitates the unlocking of the apparatus after a fall and prevents any premature locking of the apparatus.

The apparatus of the invention includes advantageously two covers, interdependent and spaced from one another, for example, by crossbars, for receiving the pulley between the opposite inner faces of the covers, wherein the wheel disks are rotatable in relation to the covers.

According to another embodiment of the invention, the abutting elements are arranged on either side of the section of the flexible tie to be braked, in order to grip it tightly and to pinch it when each wheel disk is displaced towards one of said active positions.

Alternatively, one of two abutting elements is movable and the other is fixed on its respective support. The movable abutting element rests on the fixed abutting element at the time of the displacement of each wheel disk into the active position, for example by means of a cam contour or by a smooth connection, which brings about the displacement of the movable abutting element and the pinching and gripping of the section or strand of flexible tie to be braked between the groove of the pulley and said movable abutting element.

The apparatus can also include limiter means on said covers and said wheel disk for limiting the displacement of the wheel disk in the active position. These limiter means could possibly be placed on the aforementioned abutting devices, in particular to avoid the deterioration and the cutting and shearing of the flexible tie.

According to a particular mode of realization of the invention, guiding means, such as rollers, small pulleys, or fixed crossbars are mounted between the covers of the apparatus in the proximity of the exit of two opposing sections of the flexible tie. The guiding means are disposed substantially on either side of the pulley in order to give to the flexible tie a substantially rectilinear or vertical direction in the case of use with a running hook-up point, and in order to maintain said flexible tie in the apparatus.

According to another mode of realization of the invention, guiding means are mounted between the covers of the apparatus at the exit of two opposing sections of the flexible tie. These guiding means are arranged on the same side of the pulley and in proximity to the each other in order to impart the flexible tie a substantially U-shaped form in the case of use with a fixed hook-up point.

According to another embodiment of invention, the apparatus includes an indexing system allowing to regulate and adjust the position of said abutting elements and/or of said guiding means in such a way that the same apparatus can be used in the case of a movable or a fixed hook-up point.

According to yet another embodiment of the invention, the abutting elements and/or guiding means belong to a range of modules of a predetermined shape and size, which can be adapted to the same apparatus by means of the above recited indexing system.

The apparatus of the invention can possibly include a movable counterweight at one of the ends of the flexible tie and include a braking means to maintain the counterweight in position on the flexible tie when the flexible tie is not subjected to the weight of a load.

According to another embodiment of the invention, the apparatus can include at least one element forming a scraper mounted on the apparatus close to the exit of at least one of two opposing section of flexible tie in such a way that the scraper cleans the flexible tie. This scraper-type element can be formed for example of a rigid helical wire and is coaxial with said flexible tie to be cleaned.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
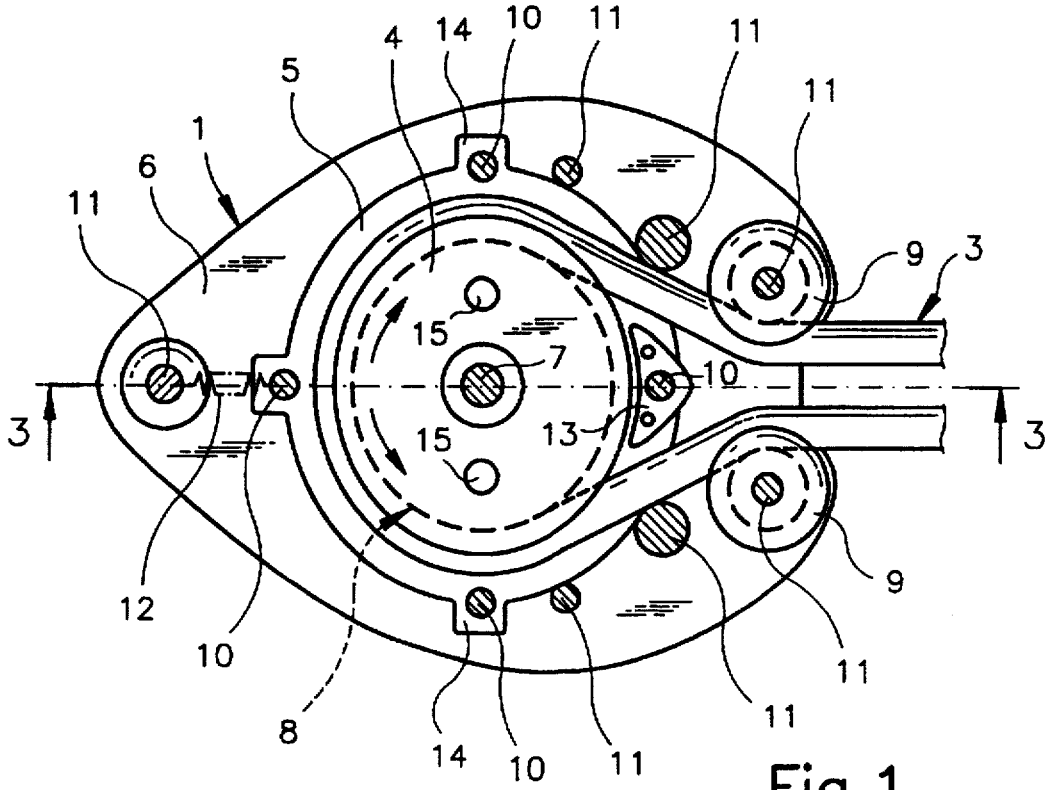
FIG. 1 is a schematic front elevational and sectional view along a central plane, perpendicular to a common rotation axis, of a first mode of realization of the apparatus of the invention for use with a fixed hook-up point.
Figure 3:
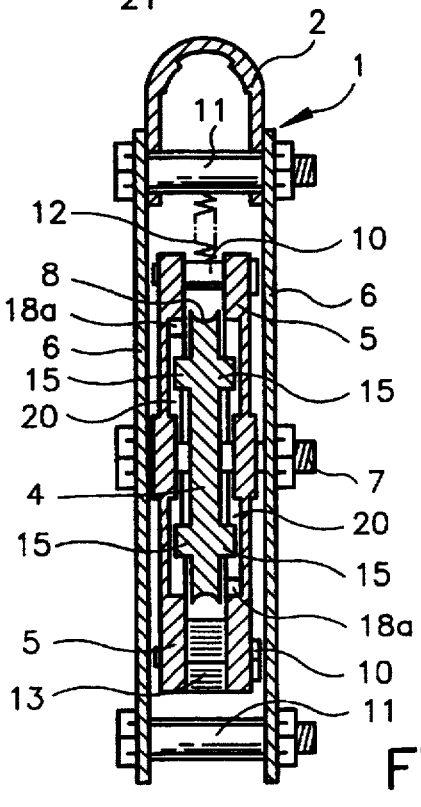
FIG. 3 is a schematic partial and sectional view of the apparatus of the invention, along section line III—III of FIG. 1.
Figure 7:
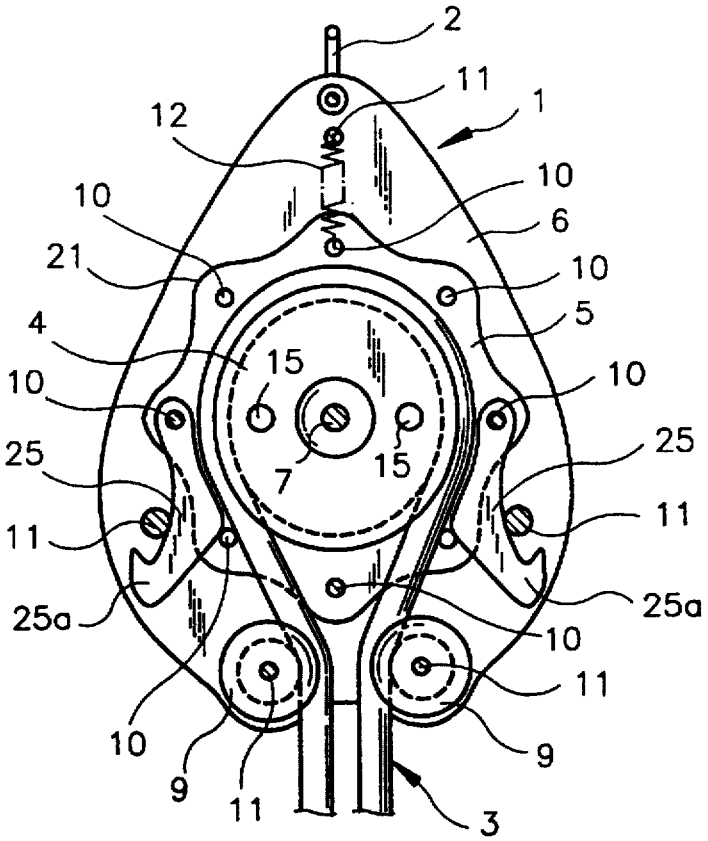
FIG. 7 is a schematic view of a third embodiment of the apparatus shown in FIG. 1.
Figure 8:
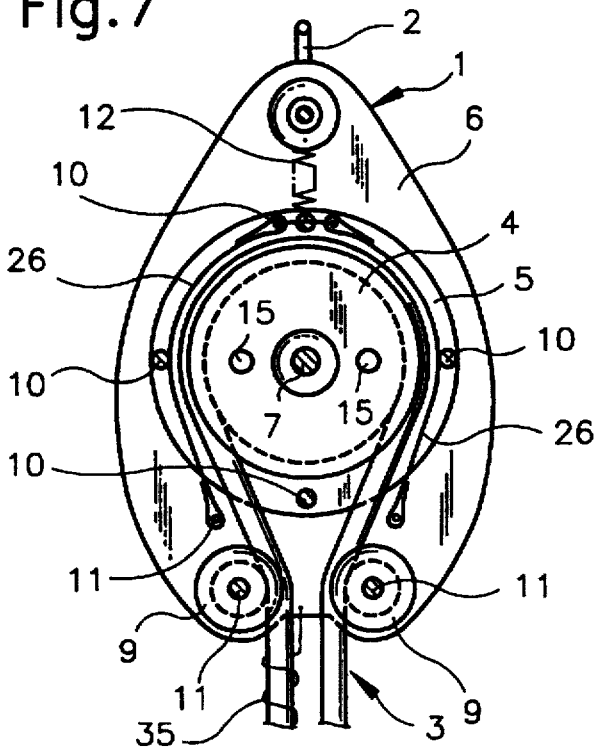
FIG. 8 is a schematic view of a fourth embodiment of the apparatus shown in FIG. 1.

According to the mode of realization shown in FIG. 1, the anti-fall security apparatus 1 is intended to be hooked to a fixed point at a height by means of a hook-up ring or safety hook, spring-hook, or clip-hook (shown in FIGS. 3, 7 and 8). This anti-fall security apparatus holds and supports a rope 3, which is movable in rotation inside said apparatus.

Of course, the rope 3 can be replaced by any adapted flexible tie, such as a cable, a strap, or a link-chain.

The rope is partially wound around a rotatable pulley 4 and the two opposing ends of the rope 3 come out, as shown in FIG. 1, substantially parallel on the same side of the pulley 4 such that the rope is imparted with a substantially U-shaped form.

One of two ends of the rope 3 is to be hooked, for example, to a worker or to a load to be lowered or to be lifted while the other end is to bear and support a counterweight (not shown) assuring the straightness and the tensioning of the rope or is to be actuated manually by another worker.

The pulley 4 is idly and freely supported between two wheel disks, wherein the wheel disks are themselves rotatably supported between two plates forming a cover 6. The pulley 4 and the wheel disks 5 are supported by a common rotation shaft 7.

The covers 6 form the frame of the apparatus and can present any shape allowing the passage of the rope into the apparatus.

The pulley 4 includes a central groove 8 for receiving the rope 3.

The cross-section of the central groove 8 can be semicircular, U-shaped, or have any shape adapted to the flexible tie which the groove is to receive.

At the exit of the apparatus, the two opposing ends or sides of the rope 3 slide respectively on a guiding means or guide element 9. These two guide elements can be formed of a roller or a small pulley, wherein distance between these two guide elements 9 is less than the diameter of the pulley 4.

The two wheel disks 5 are connected to each other by crossbars 10 at the periphery of the pulley 4, and the two covers 6 are also connected to each other by crossbars 11, disposed on the periphery of the wheel disks 5.

A spring 12 is connected at its two ends to the wheel disks 5 and to the covers 6, respectively. Thus, the wheel disks 5 cannot turn freely around the axle or shaft 7 because they are urged towards a central position, a so-called rest position (shown in FIG. 1), by a restoring elastic means formed by this spring 12.

Advantageously, this spring 12 connects one crossbar 10 of the wheel disks 5 to another crossbar 11 of the cover 6 in a swiveling and elastic way.

The rotation or swiveling of the pulley 4 is shown by two arrows directed clockwise and counterclockwise, respectively.

A fixed element forming an abutting device 13 is mounted between the opposite faces of the wheel disks 5, wherein said abutting device 13 is disposed at the periphery of the pulley 4 and between the two opposing strands of the rope 3, substantially before the contact zone of the pulley 4 and the rope 3.

Figure 2:
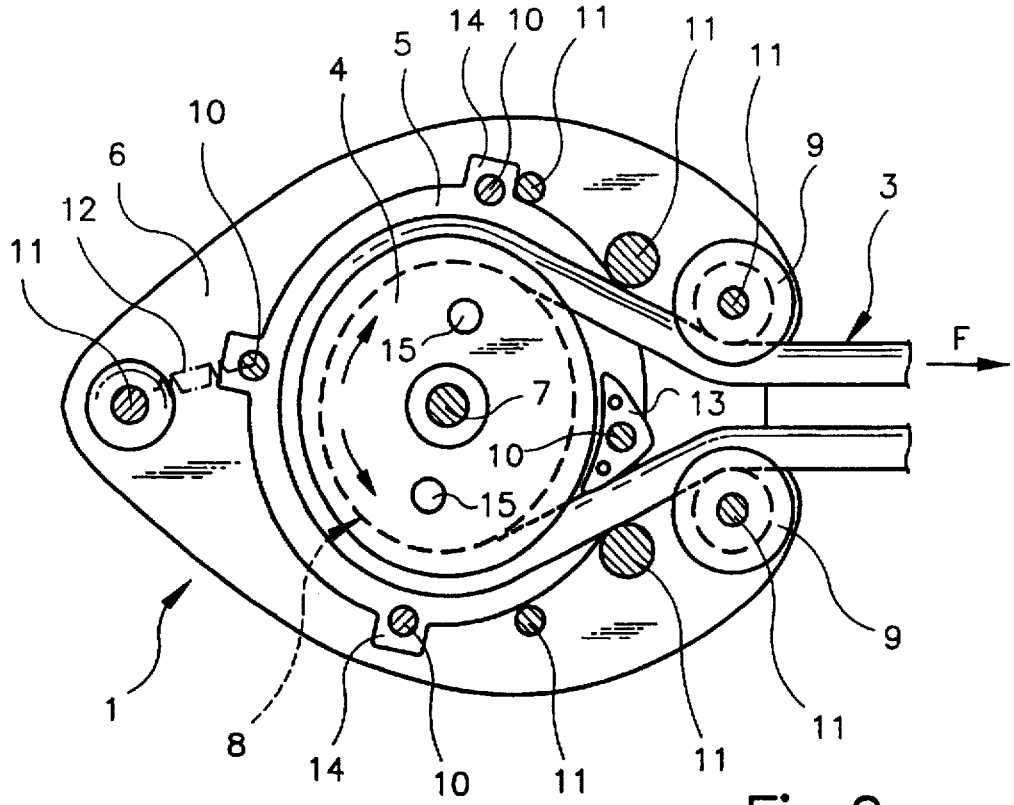
FIG. 2 shows the apparatus of FIG. 1 in active position.

The fixed abutting device 13 is integral with the wheel disks 5 and pivots and swivels jointly with these wheel disks between two inclined positions, called active positions (one of these positions is shown in FIG. 2). The fixed abutting device 13 cooperates in these positions with one of said crossbars 11, and comes to grip tightly and to pinch one of the strands of the rope 3 in such a way as to brake the rope 3 between them.

The fixed abutting device 13 has two symmetrical curved surfaces, possibly notched or toothed (see FIG. 1), able to come to pinch and grip the rope 3 upon displacement of the wheel disks 5 in their active positions.

It is seen on FIGS. 1 and 2 that the wheel disks 5 have extensions or tabs 14, protruding diametrically into the plane of the wheel disks 5 towards the outside. These tabs 14 can come to abut against one of said crossbars 11, respectively, connecting the covers 6.

It appears clearly from FIG. 2 that, when an extension or tab 14 comes to abut against a crossbar 11, it allows to limit the pinch and gripping of the rope 3 between another crossbar 11 and the fixed abutting device 13.

In the drawings, the braking of the rope 3 is realized on the strand of the rope opposite to the strand, which is directly connected to the worker or to the load, wherein the braking takes place at the beginning of the locking following an accidental fall.

One can also note that the limitation of the pinch or gripping by abutment of the extension or tab 14 on a crossbar 11 takes place on the opposite side of the strand of the rope 3, which is subjected directly to a brutal fall-down stress and action (shown by the arrow F).

Of course, it is possible to provide the braking and/or the limitation of the pinch and gripping of the rope 3 at the level of the strand of the rope 3 which is directly subjected to this stress action, or inversely.

It appears clearly from FIGS. 1 and 2 that the crossbars 11 can serve as a rotation axle for the small pulleys 9 and as a hook-up point for the spring 12, and can constitute abutting devices for the braking of the rope 3, or allow the limitation of the pinching and gripping of the rope.

The apparatus of the invention includes furthermore releasable locking means between the pulley 4 and the wheel disks 5 for moving these wheel disks 5 towards the active positions.

It is necessary to move the wheel disks 5 by means of the pulley 4 in order to render the braking of the rope 3 operational, because, without external stress action, the wheel disks 5 remain in their rest position based on the restoring elastic force of the spring 12.

It is seen from FIGS. 1 and 2 that the pulley 4 includes nipples 15 on its faces opposite to the wheel disks 5. These nipples 15 are formed eccentrically and symmetrically with regard to the axle 7 and are to receive said locking means.

Figure 4:
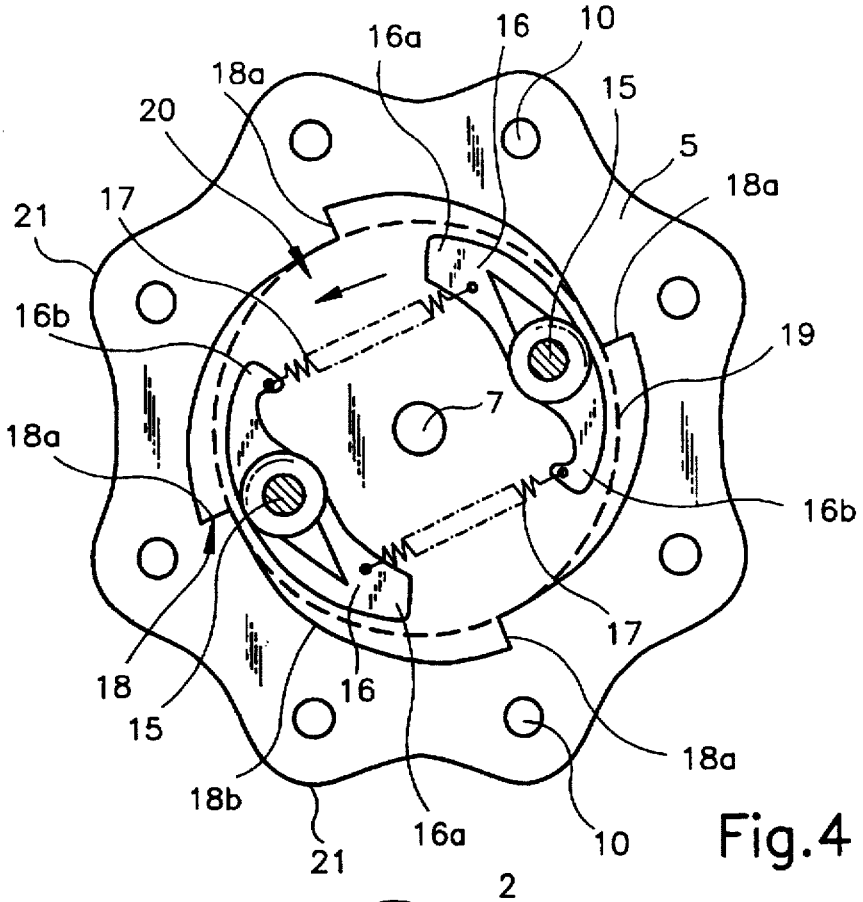
FIG. 4 is a schematic view of the locking means of the pulley of the apparatus of the invention.

FIG. 4 shows a particular example of the locking means made of two sinkheads forming the ratchets or pawls 16, mounted freely swivellable and pivotable on said eccentric nipples 15, which protrude perpendicular to the faces of the pulley 4.

The two pawls 16 are elastically connected to each other by two springs 17.

Teeth 18 are formed circularly in the opposite faces of the wheel disks 5 such that the imaginary circle 19, which passes at the top of said teeth 18, circumscribes the pawls 16, where the pawls 16 are retracted towards the center axle 7 of the pulley under the action of the elastic spring-back force of the springs 17.

The imaginary circle 19 is centered on the axle 7 of the pulley 4.

The teeth 18 are arranged on the periphery of an empty space 20 formed at the opposite faces of said wheel disks 5. Said empty space 20 houses the pawl 16.

The movable pawls 16 are able to displace themselves between a so-called retracted position (shown in FIG. 4) and a so-called locking position, in which the pawls 16 come to abut against the teeth 18 by means of one end **16*a* of the pawl 16**.

Being subjected to an elastic spring-back force towards the center 7 of the pulley, the pawls 16 move from this retracted position when the centrifugal force, generated by the rotation of the pulley 4, exceeds a predetermined threshold value as a function of the stiffness of the springs 17.

Of course, from a purely functional point of view, just one pawl 16 and one tooth 18 are absolutely necessary, but to assure a better locking security, several teeth 18 and two pawls 16 are provided.

The locking means described above is known for a long time and the present invention does not limit itself to this particular locking means.

For assuring the locking of the pulley in the both rotation directions, two identical wheel disks 5 are provided, with the same teeth 18 and the same empty space 20. When these two wheel-disks 5 are placed opposite to each other, the teeth 18 face in opposite direction, which allows the pawls, disposed on either side of the pulley 4 to lock the pulley 4 in rotation with regard to the wheel disks 5 in each rotation direction by means of the ends **16*a* and 16*b* of the pawls 16**, respectively.

Alternatively, and particularly in case where only one wheel disk is employed, one can also provide for a locking means formed on the face opposite to the pulley and to the single wheel disk. This locking means is constituted of a sinkhead, forming a bumper or stop, preferably radially movable between guide rails, formed as a projection on the face of the pulley. This movable sinkhead is able to come to engage with abutting devices or teeth, disposed circularly in the single wheel disk, when the centrifugal force exceeds a predetermined threshold value as a function of the stiffness of the spring connecting the movable sinkhead and the center of the pulley.

Thus, this locking means allows to realize a locking in the two pivoting and swivelling directions of the pulley with a single sinkhead formed on one single face of the pulley.

It is also possible to realize a locking in the two directions of the pulley with one single pawl 16 coming to abut with its two ends 16*a* or 16*b* against protrusions or teeth arranged circularly in the wheel disk 5.

In FIG. 4, the pawls 16 can come to abut against the teeth 18 only with their ends 16*a*, because each tooth 18 has a radial abutting surface 18*a* and a guide surface 18*b* which is slightly removed from the imaginary circle 19.

It is of course possible to provide instead of the single pulley 4 several pulleys cooperating amongst each other or one pulley having several grooves allowing to carry a plurality of rope windings inside the apparatus.

FIGS. 5 to 9 represent several embodiments of the apparatus of the invention which are all for use with a fixed hook-up point at a height. They differ from each other in the shape of the covers and of the wheel disks, for example, oval, circular, or lobe-shaped. They differ also by the number of springs 12, linking the covers 6 elastically to the wheel disks 5, and by their placement.

The wheel disks 5 present in FIGS. 4 to 7 and 9 a peripheral outline equipped with uniformly spaced lobes 21. These lobes 21 can have an analogous function to that of the above mentioned tabs or extensions 14.

Figure 5:
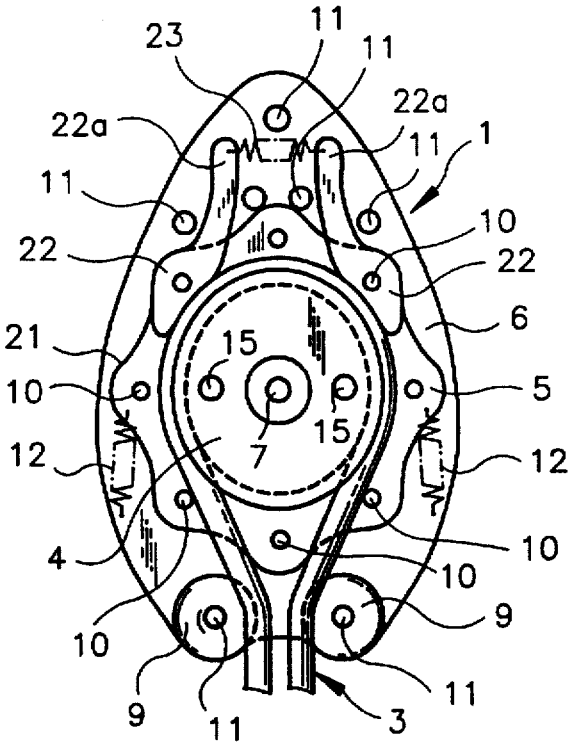
FIG. 5 is a schematic view of a first embodiment of the apparatus shown in FIG. 1.
Figure 6:
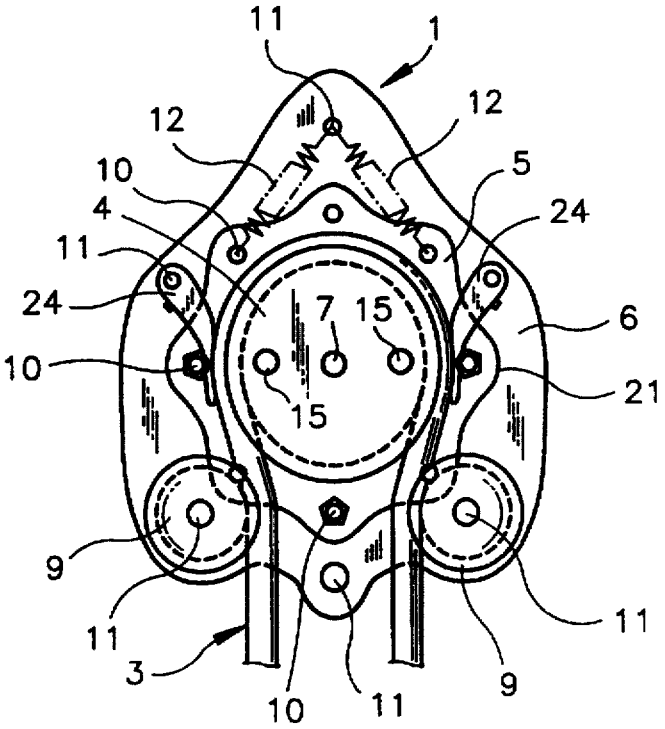
FIG. 6 is a schematic view of a second embodiment of the apparatus shown in FIG. 1.
Figure 9:
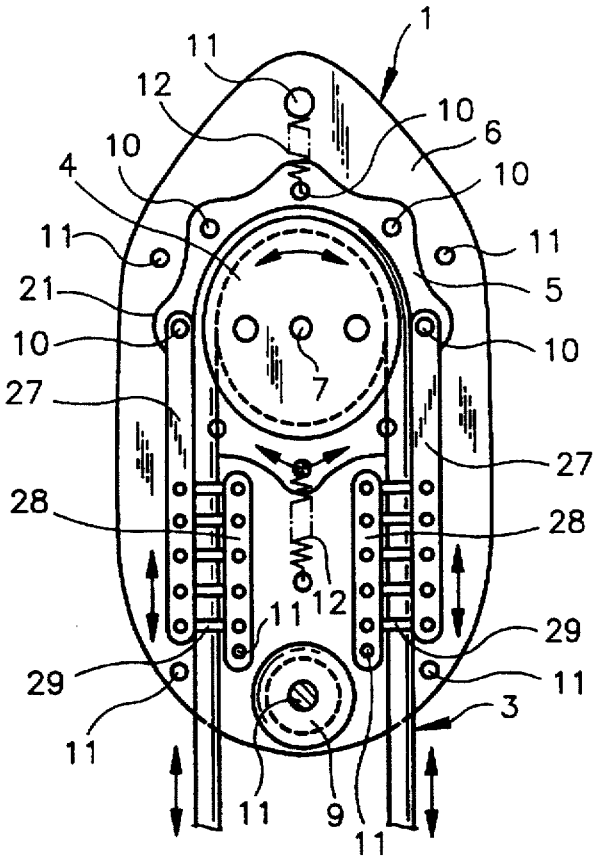
FIG. 9 is a schematic view of a fifth embodiment of the apparatus shown in FIG. 1.

In FIGS. 5, 6 and 9, two springs 12 are provided, in particular to make up for an accidental break of one of these springs.

In the FIG. 5, the springs 12 are arranged laterally on the apparatus on both sides of the pulley 4 and directed substantially parallel to the strands of the rope 3 which exit the apparatus 1.

In FIG. 6, the two springs 12 are fixed to a crossbar 11 which also serves for the hook-up at a height level. Said springs 12 are connected at their other ends to two different crossbars 10, disposed symmetrically with respect to a vertical plane passing through the axle 7 of the apparatus.

In FIG. 9, two springs 12 are arranged symmetrically with respect to the axle 7 and in a vertical plane.

The embodiments shown in FIGS. 5 to 9 differ essentially in the position and in the shape of the abutting devices which pinch and grip and brake the rope 3 in case of a fall-down or drop.

The apparatus shown in FIG. 5 includes two movable abutting devices 22, which fulfill the same function as the abutting device 13 of FIGS. 1 to 3.

The movable abutting devices 22 are arranged symmetrically with respect to a vertical plane passing through the axle 7, on the opposite side to the exit of the rope 3. These movable abutting devices 22 are articulated on the wheel disks 5 on the periphery of the pulley 4.

The movable abutting devices 22 brake the rope 3 by pinching and gripping this rope inside the groove 8 of the pulley 4. Every movable abutting device 22 is actuated by swiveling and pivoting against the rope 3 by means of an offset arm 22*a*, forming a cam. The profile of this cam rests on a fixed crossbar, forming a cam roller 10, when the wheel disks are displaced towards their active position.

The two movable abutting devices 22 are connected by a spring 23 to the free end of their respective arm 22*a* so as to maintain the abutting devices 22*a* in retracted position during the normal functioning of the apparatus 1.

In FIG. 6, two movable abutting devices 24 are provided. The abutting devices 24 are articulated on the covers 6 symmetrically with respect to a vertical plane passing through the axle 7. The movable abutting devices 24 form a cam. The free end of this cam comes to be tightly gripped between a fixed abutting device, for example a crossbar 10, and the rope 3. Thus, the braking of the rope 3 is realized by pinching and gripping the rope 3 between the end of the cam 24 and the groove 8 of the pulley 4 following to the swiveling of the wheel disks 5 and to the slippage and sliding of the fixed abutting device 10, forming the cam roller, on the profile of the cam 24.

The cams 24 are arranged on the side opposite to the exit of the rope 3 in order to brake the strand of the rope 3 opposite to the strand of the rope 3 which is directly connected to the load or to the operator, which allows to improve the braking of the rope 3 by friction of the rope 3 over about half the circumference in the groove of the pulley.

It would of course be possible to arrange the cams 24 on the same side as the side of the exit of the rope 3 in order to brake the strand of the rope 3 which bears and supports directly the load or the operator.

In the embodiments shown in FIGS. 5 to 8, the abutting devices for the braking of the rope 3 are arranged outwardly of the rope 3, contrary to the mode of realization shown in FIGS. 1 to 3.

In the embodiment shown in the FIG. 7, the apparatus also includes two movable abutting devices 25 articulated on the wheel disks 5. These elements form respectively a cam, which comes to pinch the rope 3 against the groove of the pulley following the displacement of one part of the cam profile on a fixed abutting device, forming a cam roller, for example a crossbar 11, provided between the covers 6.

The cams 25 include furthermore a shoulder forming a hook 25*a* at their free ends, wherein said hooks 25*a* come to be engaged with an abutment, provided between the covers 6, and preferably with the crossbar 11, forming the cam roller, following the displacement of the wheel disks 5 in active position, which allows in particular to limit the pinching of the rope 3 and to avoid any risk of cutting or shearing or deterioration of the rope 3.

In FIG. 8, the braking of the rope 3 is assured by flexible and supple abutting devices 26 made for example by a cable section length. Every flexible abutting device 26 is connected with its ends to a crossbar 10 of the wheel disk and to a crossbar 11 of the cover, respectively.

The flexible abutting device 26 follows the contour of the rope 3 partially along its passage on the pulley 4. The ends of this flexible abutting device 26 are disposed substantially on either side of the pulley 4.

Thus, the braking of the rope 3 is realized by pinching said rope 3 between said flexible abutting device 26 and the groove 8 of the pulley 4. This pinching is moreover performed over a greater part of the circumference of the pulley, as compared to the previously described embodiments.

These flexible abutting devices 26 are arranged in the FIG. 8 symmetrically in relation to a median plane passing through the axle 7.

A rigid helical wire, forming a scraper 35, is fixed by one of its ends to the apparatus 1 at the exit of one of the two opposite sections or lengths of the flexible rope 3. This scraper 35 cleans the rope of all the dirt or mud which could jam the mechanism of the apparatus.

The wire, scraper 35 is disposed coaxial with said length or section of flexible rope to be cleaned and its other end is free.

In FIG. 9, the braking of the rope 3 is carried out by means of two movable abutting devices 27 and 28, articulated by an end on the wheel disks 5 and the covers 6, respectively. These movable abutting devices 27 and 28 are formed of two longitudinal bars which are connected to each other in an articulated way by a series of parallel rings 29.

At the exit of the pulley 4, each opposite strand of the rope 3 is guided laterally and longitudinally by said bars 27 and 28, and passes through the central hole 30 of the rings 29. When the wheel disk 5 moves towards an active position, the bars or abutting devices 27 and 28 remain substantially oriented in the same direction, but the rings 29 slant to follow the movement of the bars 27 and brake thus the rope at the level of its two opposite strands.

Figure 10A:
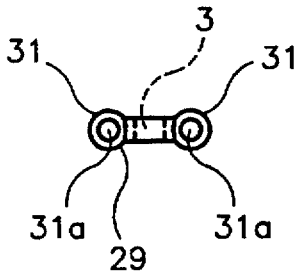
FIG. 10*a* is a schematic lateral view of the parallel rings of FIG. 9.
Figure 10B:
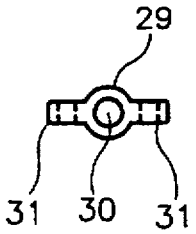
FIG. 10*b* is a schematic top view of the parallel rings of FIG. 9.

The rings 29 are shown in more detail in the FIGS. 10*a* and 10*b*. The rings 29 include a central hole 30, wherein the rope 3 passes through the hole 30. Each ring 29 has two paws or tabs 31 which present a projection on the periphery of the ring 29 diametrically with respect to the hole 30. These paws or tabs 31 have in each case a hole 31*a*, having an axis perpendicular to the axis of the hole 30 for the articulated connection to the two bars 27 and 28.

The apparatus 1 of the invention can of course be hooked up at a height in another way than with the hook-up ring 2, for example at the level of the central axle 7 of the apparatus. This hook-up type is particularly advantageous to lift the rotation axle of the pulley 4 when the apparatus has to be fixed for example on a three-legged stand or tripod at an access point above an underground canalization network. It is also possible to connect one of the ends of the rope to a hoisting winch to mount and rise or to descend a load or an operator.

As a variant, it is also possible to add another pulley between the two covers, wherein the pulley is freely rotatable on the common axle, and able to receive another flexible tie. One end of the rope is connected to the recited hoisting winch and the other end to an operator such as to lift or lower said operator independent of the flexible tie assuring his safety.

Figure 11:
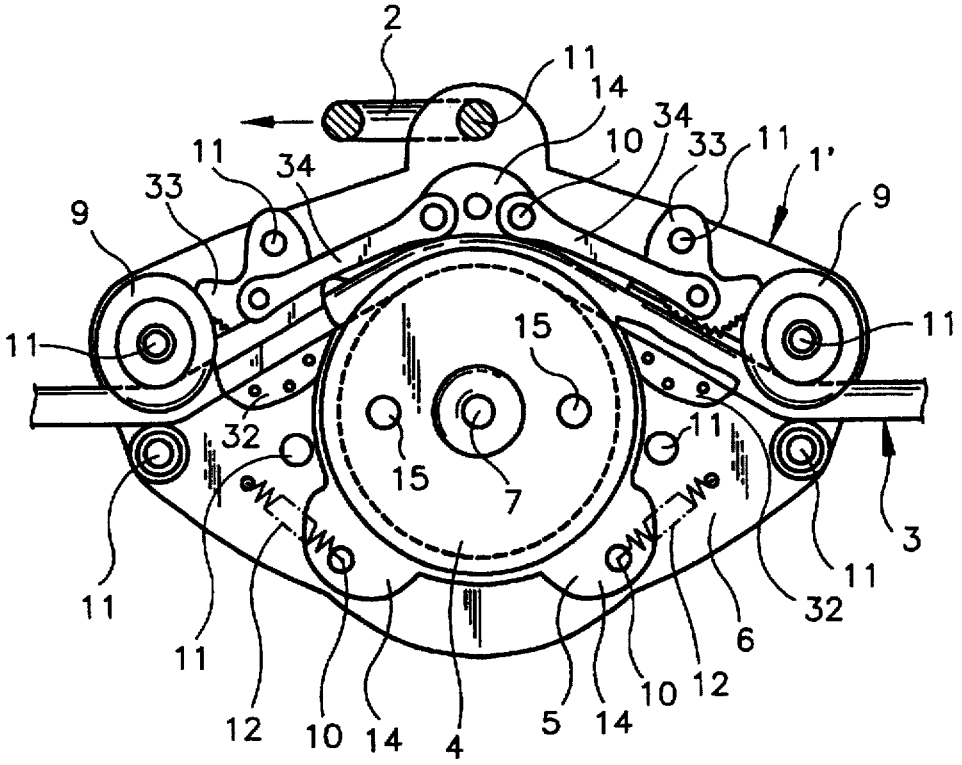
FIG. 11 is a schematic front elevational and sectional view along a central plane, perpendicular to a common rotation axis, of a second mode of realization of the apparatus of the invention for use with a running hook-up point.

An apparatus 1' of the invention for use with a running hook-up point on the rope is shown in FIG. 11.

Contrary to the previously described modes of realization, the rope 3 is in this case hooked at one end at a height and at the other end includes a counterweight (not shown here), assuring a predetermined tension in the rope 3.

At the exit of the apparatus 1', the two opposite strands of rope 3 are thus aligned and follow a slightly sinuous line inside of this apparatus 1'.

The hook-up ring 2 is in this case to be hooked directly to the harness of an operator who carries the apparatus 1' with him at the moment of his descent or of his ascent.

This harness can also be directly hooked in at the level of the common axle 7, for example by means of a loop or handle.

In the mode of realization shown in FIG. 11, the braking of a strand of rope 3 takes place between a U-shaped stirrup or clip 32, in which slides the rope 3 at the exit of the pulley 4, and a movable and notched abutting device 33, articulated at an end on the covers 6 and at the other end on an arm 34. The arm 34 is itself articulated on a tab 14 of the wheel disks 5.

The stirrup 32 and the movable abutting device 33 are disposed on either side of the rope 3 at the exit of the pulley 4 and come to grip the rope 3 tightly in case of fall of the operator.

The two movable abutting devices 33 are disposed symmetrically with respect to a median plane passing through the axle 7 of the pulley 4.

The apparatus 1' is disposed horizontally in the FIG. 11, but it can be oriented vertically when it is used.

The apparatus 1' is particularly reliable in regard to safety when it is used with a running hook-up point, since, even if the operator hooks himself to the apparatus, the braking of the rope 3 is always operational.

Furthermore, the operator does not need to continually support the weight of the apparatus 1', for example, when the operator is in stationary position, because the weight of the apparatus generates an automatic braking of the apparatus on the rope 3.

It is also possible to use jointly the apparatus 1 and 1' of the invention to double the safety of the operator or during the handling of a load.

For this purpose, when using one apparatus 1 according to the invention, it suffices to provide for a second apparatus 1' according to the invention, wherein this second apparatus 1' is mounted in the sliding way on the strand of rope opposite to the strand of rope directly attached to the operator or to the load, and to attach this second apparatus 1' also to the operator or to the charge.

Thus, if the strand of rope directly linked to the operator or to the load breaks, the second apparatus 1' prevents the fall of the operator or the load by braking on the opposite strand of rope, which has been locked at the level of the apparatus 1 hooked at a height, thanks to the braking in the two directions of the latter.

In fact, the locking of the opposite strand of rope, in the case of the break of the strand directly linked to the operator or to the load, is realized based on the counterweight which is fastened to it.

Advantageously, the counterweight is movable and can include a braking means to maintain the counterweight in position on the rope in the absence of the external stress action.

For example, when the counterweight comes to abut against the apparatus of the invention or jams in the scaffolding, in which the operator linked to the apparatus of the invention goes up and down, the movable counterweight allows the operator to continue his descent or his climb.

This braking means can be formed, for example, by an inner tube having a diameter slightly smaller than the rope being used or by a member able to exert a predetermined pressure on the rope.

The counterweight can have an ovoid or hemispherical shape and can include an outer elastic coating for the absorbing and damping of the shocks and of the impact. This coating can be made, for example, of a foam material to protect the user from possible shocks and impact with the counterweight.

One can also provide a variable-mass counterweight including an internal enclosure that can be filled with a fluid or a solid material, such as water or sand.

The apparatus of the invention can of course use a lifting block to reduce the forces applied on the rope.

For example, the small pulley 9 of the embodiment shown in FIG. 9 can serve as such a lifting block.

It is also possible to provide a single apparatus including an index system formed by crossbars 10 and 11 and allowing to adapt this apparatus for use with a movable or fixed hook-up point by displacing of the abutting devices for braking the rope as well as the guide members of the rope at the exit of the apparatus.

The functioning of the apparatus 1 is briefly described in the following with reference to FIGS. 1–4.

In case of a fall, for example of an operator, a stress action F is exerted on the strand of rope 3 which is directly connected to the operator. This action brings about an acceleration of the unwinding of the rope 3 and, based of the friction contact between the groove 8 of the pulley 4 and the rope 3, an acceleration of the rotation of the pulley 4.

When the centrifugal force exerted on the ratchets 16 by the rotation of the pulley 4 exceeds a predetermined threshold value as a function of the stiffness of the springs 17, the ratchets come to abut in the teeth 18, which causes the locking in relative rotation of the wheel disks 5 and the pulley 4.

The drive of the pulley 4 by the unwinding of the rope 3 is then transmitted to the wheel disks 5 which pivot against the restoring action of the spring 12, and which wheel disks 5 brings about a pinching of a strand of rope 3 between the abutting device 13 and a crossbar 11.

The rope 3 is then braked in an extremely short period of time.

The unlocking of the apparatus of the invention is automatic as soon as the stress action F is suppressed, based on the elastic restoring action of the spring 12.

The functioning of the apparatus 1' of the invention is now described with reference to FIG. 11.

In case of a fall, the apparatus 1' is quickly driven downwardly, which accelerates the winding speed of the pulley 4 on the rope 3 and brings about in the same way the relative locking of wheel disks 5 and of the pulley 4 and the braking of a strand of rope 3.

The unlocking is also realized automatically by suppressing the stress action exerted on the apparatus 1'.

It will be understood that each of the elements described above, or two or more together, may also find a useful application in other types of hook-up-type security apparatuses differing from the types described above.

While the invention has been illustrated and described as embodied in the context of an anti-fall security apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Anti-fall-down security apparatus comprising a frame having at least one cover (6);

a fixed abutting device (11) fixedly attached to the cover (6);

a central axis (7) fixedly attached to an internal surface of the frame;

at least one movable wheel disc (5) having a movable abutting device (13) and pivotally supported by the central axis (7);

a ring-grooved pulley (4) for receiving a flexible rope (3) and rotatably supported by the central axis (7), wherein the flexible rope (3) runs between the fixed abutting device (11) and the movable abutting device (13), and wherein the movable wheel disc (5) has teeth (18*a*), and wherein the ring-grooved pulley (4) has at least two ratchets (16) pivotally attached to at least one recentered axis (15) being integrally attached to the ring-grooved pulley (4), and wherein by exceeding a threshold value of rotation speed of the ring-grooved pulley (4) the ratchets (16) engage the teeth (18*a*) causing a rotation of the movable wheel disc (5) towards an active position and clamping the flexible rope (3) by the movable abutting device (13), and wherein the movable disc (5) stays in a rest position when the rotation speed of the ring-grooved pulley (4) is lower than the threshold value of the rotation speed of the pulley (4).

2. Apparatus according to claim 1, wherein the wheel disc (5) is urged towards the rest position by recalling elastic means formed by springs (12) joining the frame to the movable wheel disc (5).

3. Apparatus according to claim 1, wherein two wheel-discs (5) are interdependent and spaced by crossbars (10), and wherein the pulley (4) is placed between the two wheel-discs (5).

4. Apparatus according to claim 1, wherein the movable abutting device and the fixed abutting device grip and pinch the flexible rope for braking the rope when the wheel disc is moved towards the active position.

5. Apparatus according to claim 1, wherein the movable abutting device (22, 24, 25, 26) rests on the fixed abutting device (11) at the time when the movable wheel-disc (5) comes into the active position, and wherein a displacement of the movable wheel-disc (5) causes a displacement of the movable abutting device and pinching the flexible rope between the ring-grooved pulley and the movable abutting device.

6. Apparatus according to claim 1 further comprising limiting means (11, 14, 25*a*) for setting the active position.

7. Apparatus according to claim 1, further comprising guiding means (9) mounted at the frame of the apparatus (1) and disposed at an exit of the flexible rope to give to said flexible rope a "U" shape.

8. Apparatus according to claim 7, wherein the apparatus (1, 1') is made according to an index system for adapting the apparatus (1, 1') for a use with a movable fastening point or stationary fastening point by changing said abutting devices and said guiding means belonging to a range of modules of predetermined shape and size.

9. Apparatus according to claim 1, wherein a counterweight is attached to one of the ends of the flexible rope, and includes a braking means to maintain the counterweight when the flexible rope is unloaded.

10. An anti-fall-down security apparatus comprising a frame having an internal surface and formed by at least one cover;

a fixed abutting device fixedly attached to the frame;

a central axis supported on the internal surface;

a ring-grooved pulley to receive a flexible rope and idly supported by the central axis;

a movable wheel disk having an internal face and pivotally supported by the central axis, wherein the movable wheel disk has an abutting device fixedly attached to the movable wheel disc;

locking means being formed on the internal face of said pulley and on the internal face of said wheel disk to selectively allow a rotation of said pulley together with said wheel disk, wherein the locking means includes:

teeth furnished at said movable wheel disk;

a non-centrally located axis;

at least two ratchets furnished to said ring-grooved pulley and arranged on said non-centrally located axis and constructed integral with the ring-grooved pulley in such a way as to allow an automatic working in both directions of the anti-fall-down security apparatus to brake and block thee flexible rope by the fixed abutting device and the abutting device, wherein the flexible rope slides in a central groove of said ring-grooved pulley while the movable wheel disk is in a rest position.

11. The apparatus according to claim 10, wherein the fixed abutting device is placed in a lower position on said frame.

12. The apparatus according to claim 10, wherein the movable wheel disk is urged towards said rest position of the movable wheel disk by a restoring elastic means linking said frame to said movable wheel disk.

13. The apparatus according to claim 12, wherein the restoring elastic means is furnished by springs.

14. The apparatus according to claim 10, further comprising a second wheel disk disposed solitary and spaced away from the movable wheel disk, wherein said ring-grooved pulley is received between internal faces of said wheel disks, the wheel disks being movable in rotation relative to the frame.

15. The apparatus according to claim 14, wherein the second wheel disk is disposed spaced away from the movable wheel disk by crossbars.

16. The apparatus according to claim 10, wherein the abutting movable wheel disk and the ring-grooved pulley have a crenelated surface and are arranged in two parts of a flexible link section to brake gripping the flexible link section and to pinch the flexible link section when the movable wheel disk is moved towards one of two active positions.

17. The apparatus according to claim 10, wherein one member of the fixed abutting device and and the abutting device is movable, and wherein the other one member of the fixed abutting device and the abutting device is in a fixed position on a respective support, wherein the movable one member is resting on the fixed abutting device at the time of the displacement of each movable wheel disk in an active position, which the active position provokes a displacement of the abutting device, and a pinch of the flexible rope section to brake between the central groove of the ring-grooved pulley and said movable one member.

18. The apparatus according to claim 17, wherein the apparatus further comprises limiter means for setting the active position of each wheel disk, these limiter means being capable of being realized on the abutting device and fixed abutting device.

19. The apparatus according to claim 18, further comprising an index system allowing to regulate the position of said abutting device and fixed abutting device, in such a way to allow a utilization of the same apparatus in case of a movable or fixed hooking point, said abutting device and fixed abutting device belonging to a range of modules of predetermined shape and size, which can be adapted on the same apparatus by an intermediary of said index system.

20. The apparatus according to claim 10, further comprising guiding means mounted to the frame at an exit opening of two opposing sections of the flexible rope, and said guiding means being arranged on the same side of the ring-grooved pulley wherein the guiding means are disposed close to the ring-grooved pulley to give to said flexible rope a "U" shape in case of utilization at a fixed hooking point.

21. The apparatus according to claim 20, further comprising an index system allowing to regulate position of said guiding means, in such a way to allow utilization of the same apparatus in case of a movable or fixed hooking point, said guiding means belonging to a range of modules of predetermined shape and size, which can be adapted on the same apparatus by an intermediary of said index system.

22. The apparatus according to claim 10, further comprising a counterweight attached to one or another of the ends of the flexible rope, and including a braking means to maintain the counterweight in position on the flexible rope when the flexible rope is unloaded.

* * * * *